United States Patent [19]

Idota et al.

[11] 4,328,306

[45] May 4, 1982

[54] PROCESSING METHOD FOR COLOR PHOTOGRAPHIC MATERIALS

[75] Inventors: Yoshio Idota; Minoru Yamada, both of Ashigara, Japan

[73] Assignee: Fuji Photo Film Co., Ltd., Kanagawa, Japan

[21] Appl. No.: 181,560

[22] Filed: Aug. 27, 1980

[30] Foreign Application Priority Data

Aug. 29, 1979 [JP] Japan ..... 54-110003

[51] Int. Cl.[3] ..... G03C 5/32

[52] U.S. Cl. ..... 430/393; 430/400; 430/430; 430/461; 430/943

[58] Field of Search ..... 430/393, 400, 430, 461, 430/943

[56] References Cited

U.S. PATENT DOCUMENTS 3,256,092 6/1966 Means et al. ..... 430/461

3,870,520 3/1975 Shimamura et al. ..... 430/393

FOREIGN PATENT DOCUMENTS 2330579 9/1975 Fed. Rep. of Germany ..... 430/400

OTHER PUBLICATIONS

Defensive Publication T878,007, published Sep. 8, 1970.

Defensive Publication T862,009, published May 6, 1969.

*Primary Examiner*—J. Travis Brown

*Attorney, Agent, or Firm*—Sughrue, Mion, Zinn, Macpeak & Seas

[57] ABSTRACT

A method for bleaching silver halide color photographic materials is described using a bleach solution containing an organic acid metal complex salt and hydrogen peroxide or a compound releasing hydrogen peroxide, wherein the bleaching activity of the bleach solution can be effectively maintained for a long period of time by supplying thereto a replenisher composed separately of a composition containing hydrogen peroxide or a compound releasing hydrogen peroxide and a composition containing an organic acid metal complex salt, which are separately stored and added as a mixture thereof or separately to the bleach solution when the activity thereof is weakened during processing or during storage of the bleach solution.

12 Claims, No Drawings

PROCESSING METHOD FOR COLOR PHOTOGRAPHIC MATERIALS

BACKGROUND OF THE INVENTION

1. Field of the Invention

This invention relates to a photographic processing method for silver halide color photographic materials, and more particularly to a photographic processing method for silver halide color photographic materials having a sufficient bleaching activity and capable of forming color images having good image quality. More specifically, the invention relates to a method for stably maintaining the function of bleach solution by replenishing a bleach solution which has a sufficient bleaching activity but is unstable during prolonged photographic processing.

2. Description of the Prior Art

In photographic processing of silver halide color photographic materials, after imagewise exposure, the silver halide color photographic material (the silver halide emulsions of which may have been previously fogged) is usually developed in a developer (i.e., a developing solution) containing an aromatic primary amine color developing agent in the presence of dye-forming couplers to form a color image, and thereafter developed silver formed simultaneously is rehalogenated by bleaching and removed together with undeveloped silver halide by fixing (combined bleaching and fixing steps are referred to as "blixing").

An organic acid such as an aminopolycarboxylic acid-metal complex used as a bleaching agent for a bleach solution causes less environmental pollution, especially water pollution, than earlier methods, and hence such an organic acid-metal complex has frequently been used as a bleaching agent. However, an organic metal complex generally has a relatively low oxidizing power and may have insufficient bleaching power. Hence, although when a bleach solution containing such a bleaching agent is used for bleaching low speed silver halide color photographic materials having mainly, for example, silver chlorobromide emulsion layers, the desired object may be satisfactorily attained, when the bleach solution is used for processing high speed silver halide color photographic materials having mainly dye-sensitized silver iodochloride or silver iodobromide emulsion layers, and, in particular, high speed silver halide color photographic materials having high silver content silver halide emulsion layers (by expression "high silver content silver halide emulsion layers" is meant silver halide emulsion layers wherein the total amount of silver in the blue-sensitive, green-sensitive, and red-sensitive silver halide emulsion layers is more than about 20 mg per 100 $cm^2$), the bleaching action by the bleaching agent is insufficient, causing poor silver removal and so-called poor recoloring (that is, a state wherein dyes formed by the oxidation coupling of the oxidation product of a color developing agent and couplers remain in the state of leuco dyes, which are reaction intermeidates, after bleaching, and thereby complete dyes are not formed). These difficulties must be overcome to attain the rapid processing of high speed silver halide color photographic materials.

As a method of overcoming these difficulties, it has been proposed in Japanese Patent Application (OPI) No. 109731/75 (the term "OPI" as used herein refers to a "published unexamined Japanese patent application") to add hydrogen peroxide to an organic acid iron or cobalt complex salt. Such bleach solution is generally subject to the fatal defect that leuco dyes may be converted into dyes when silver halide color photographic materials are processed by the bleach solution immediately after the preparation thereof, but when the bleach solution is allowed to stand after the preparation thereof, the oxidizing power of the bleach solution decreases rapidly with the passage of time. Thus the oxidation of silver and leuco dyes becomes insufficient, and this defect occurs even under acidic conditions (pH 2 to 6) in which the bleach solution is relatively stable. This defect is believed to be caused by the decomposition of hydrogen peroxide in the bleach solution, promoted by metal ions.

Also, the use of a large amount of an aminopolycarboxylic acid iron complex is undesirable not only from an environmental viewpoint, since in such a case the concentration of iron ions increases, but also from an economic viewpoint, in that the costs for raw materials increase.

On the other hand, since hydrogen peroxide decomposes to form water, it is an ideal oxidizing agent which causes no environmental pollution. Therefore, it has long been desired in the field of the art to achieve practical use of a bleach solution using hydrogen peroxide for color photography.

However, although hydrogen peroxide is a strong oxidizing agent, it is practically impossible to bleach silver in color photographic materials using hydrogen peroxide alone as a bleaching agent.

As a method of solving the foregoing difficulties, it has been proposed to add a relatively small amount of an inorganic metal salt to a bleach solution containing hydrogen peroxide, as disclosed in Japanese Patent Application (OPI) No. 1026/79. However, in the above-described method the hydrogen peroxide in the bleach solution is liable to decompose, making it difficult to maintain the function of the bleach solution at a constant level for a longer period of time than one month, and hence the method is difficult to use from a practical viewpoint.

For use of an etching bleach solution, it is proposed to use hydrogen peroxide in combination with a stabilizer composition comprising citric acid and polyalkylene oxide as stabilizers (Japanese Patent Application (OPI) No. 149401/78).

Hitherto, it has been practiced, to keep the function of not only a bleach solution, but also other photographic processing solution baths, at constant level by adding a replenishing solution having the same as or a similar composition to that of the bleach solution or other processing solution to the processing bath. However, since the bleach solution using hydrogen peroxide and a metal salt is very poor in stability, it is not practically possible to maintain the function of a bleach solution at a constant level even by performing the replenishing of the processing composition in a conventional manner.

SUMMARY OF THE INVENTION

An object of this invention is, therefore, to provide a method of bleaching silver halide color photographic materials using an improved bleach solution having excellent bleaching function without causing poor coloring and environmental pollution.

Another object of this invention is to provide a method of using a bleach solution containing hydrogen peroxide, which is unstable, difficult to manage, and has not hitherto been practically used due to the very poor stability thereof in a conventional solution, as the main bleaching component. The use of the solution is in such a manner that the bleach solution can be practically used while easily maintaining the function thereof.

It has now been discovered that the above-described objects of this invention can be attained by using a replenisher composed separately of a first composition containing hydrogen peroxide or a compound releasing hydrogen peroxide (it is to be understood that combinations of hydrogen peroxide and compound(s) releasing hydrogen peroxide are also considered to be within the scope of this invention), and a second composition containing an organic acid metal complex salt in processing silver halide color photographic materials with a bleach solution containing an organic acid metal complex salt and hydrogen peroxide or a compound releasing hydrogen peroxide.

DETAILED DESCRIPTION OF THE INVENTION

It has been found that $H_2O_2$ and a neutral salt can be replenished separately. The concentration of $H_2O_2$ is independent from bleaching power once a certain concentration of $H_2O_2$ is reached, unlike most other additives for photographic elements. In addition, no adverse effect is caused ever y an excess of $H_2O_2$ that may be present in a bleaching solution. Based on this finding, the present invention has been achieved.

The activity of the $H_2O_2$ (hydrogen peroxide) is maintained at a concentration of at least 0.02 mol/l in the bleach solution, and is not changed even in a greater concentration. Accordingly, after timing for replenishing $H_2O_2$ is roughly estimated by, e.g., an overflown amount, $H_2O_2$ can be added to a bleaching solution steadily without precisely controlling the amount of $H_2O_2$ to be replenished, since an excess of $H_2O_2$ does not damage any photographic property. This is surprising because most of photographic addenda adversely affect photographic properties, such as causing fog, reducing sensitivity, etc., when present in an excess amount and as a result, these addenda must generally be added to the photographic system in an extremely controlled manner.

The invention also has additional merits, as described below:

In the bleach solution used in this invention, the concentration of an organic acid metal complex salt can be reduced as compared to that of a bleach solution using an organic acid metal complex salt as the main component without using hydrogen peroxide or a compound releasing hydrogen peroxide. Hence the bleach solution can be concentrated, and the size of the tank for the bleach solution can be reduced. Therefore, the transportation and storage of the bleach solution are facilitated, and the amount of the overflowing bleach solution from the process bath caused by the addition of the replenisher is reduced, since the amount of the replenisher used during processing can be reduced. Consequently, the amount of discharged bleach solution is reduced, which results in facilitating control plans for the pollution caused by the waste solution.

The organic acid metal complex salt used in this invention is a compound which oxidizes metallic silver formed by development into silver halide. Examples include the chelated products of aminopolycarboxylic acids, organic phosphonic acids or other organic acids such as oxalic acid, citric acid, etc., and ions of high valence metals, such as iron, cobalt, copper, etc. Preferred chelating agents are the polycarboxylic acids shown by formula (I) or formula (II) below:

$$R_1(COOH)_l \qquad (I)$$

wherein $R_1$ represents a single bond, an unsubstituted or substituted alkylene group having from 1 to 6 carbon atoms wherein the substituent is a hydroxy group and/or a carboxy group, preferably a carboxy group, a $-(CH_2)_m-O-(CH_2)_n-$ group wherein m and n are positive integers and m+n is from 2 to 6, a $-(CH_2)_{m'}-S-(CH_2)_{n'}-$ group wherein m' and n' are positive integers and m'+n' is from 2 to 6, or an alkenylene group having 2 to 6 carbon atoms; l represents an integer of 2 or 3; and when $R_1$ is a single bond, l is 2.

Preferred examples of the polycarboxylic acid represented by the formula (I) are as follows:

Oxalic acid,
Malonic acid,
Diglycollic acid, and
Thiodiglycollic acid.

Chelating agents used for forming the complex salts used in this invention also include the aminopolycarboxylic acids represented by the following formula (II):

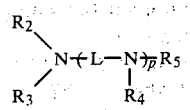

(II)

wherein $R_2$, $R_3$, $R_4$ and $R_5$ each represents a carboxyalkyl group wherein the alkyl moiety has 1 or 2 carbon atoms, a hydroxyalkyl group having from 1 to 2 carbon atoms and/or a hydrogen atom; p represents 0 or an integer of from 1 to 3; L represents an alkylene group having from 2 to 4 carbon atoms, a $-(CH_2)_x[O-(CH_2)_y]_z$ group wherein x is an integer of from 2 to 4, y is an integer of from 2 to 4 and z is an integer of from 1 to 3, a 6-membered cyclic alkylene group, or an arylene group (e.g., phenylene); and the aminopolycarboxylic acid of the formula (II) has at least 1 carboxy group.

Typical examples of the aminopolycarboxylic acids of the formula (II) or the salts thereof are as follows:

Ethylenediaminetetraacetic acid,
Ethylenediaminetetraacetic acid disodium salt,
Ethylenediaminetetraacetic acid diammonium salt,
Ethylenediaminetetraacetic tetra(trimethylammonium) salt,
Ethylenediaminetetraacetic acid tetrapotassium salt,
Ethylenediaminetetraacetic acid tetrasodium salt,
Ethylenediaminetetraacetic acid trisodium salt,
Diethylenetriaminepentaacetic acid,
Diethylenetriaminepentaacetic acid pentasodium salt,
Ethylenediamine-N-(β-oxyethyl)-N,N',N'-triacetic acid,
Ethylenediamine-N-(β-oxyethyl)-N,N',N'-triacetic acid sodium salt,
Ethylenediamine-N-(β-oxyethyl)-N,N',N'-triacetic acid triammonium salt,
Propylenediaminetetraacetic acid,
Propylenediaminetetraacetic acid sodium salt,
Nitrilotriacetic acid,
Nitrilotriacetic acid sodium salt,
Cyclohexanediaminetetraacetic acid,
Cyclohexanediaminetetraacetic acid sodium salt, Iminodiacetic acid,
Dihydroxyethylglycine,
Ethyl ether diaminetetraacetic acid,
Glycol ether diaminetetraacetic acid,
Ethylenediaminetetrapropionic acid, and
Phenylenediaminetetraacetic acid.

Chelating agents used for forming the complex salts used in this invention also include the organic phosphonic acids represented by the following formulae (III-a) or (III-b):

$$R_6\text{—}PO_3H_2)_q \quad \text{(III-a)}$$

$$R_6\text{—}LPO_3H_2)_q \quad \text{(III-b)}$$

wherein $R_6$ represents a substituted or unsubstituted alkyl or alkylene group having from 1 to 4 carbon atoms wherein the substituent is a hydroxy group and/or a carboxy group, or a substituted or unsubstituted diaminoalkylene group having from 2 to 16 carbon atoms wherein the substituent is a hydroxy group; L represents an alkylene group having 1 to 2 carbon atoms; and q represents an integer of from 1 to 5.

Typical examples of the organic phosphonic acids of the formulae (III-a) and (III-b) are as follows:

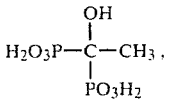

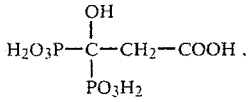

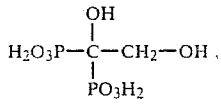

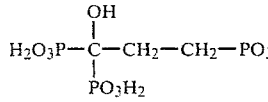

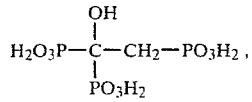

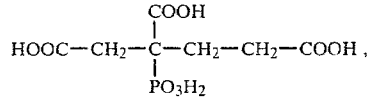

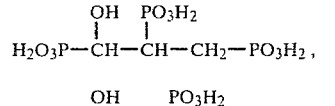

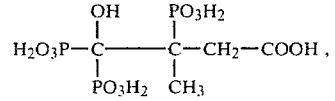

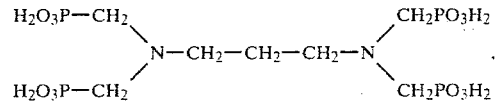

and

-continued

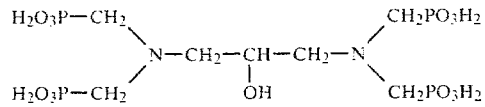

Of these chelating agents, the aminopolycarboxylic acids and phosphonic acids are preferred; the aminopolycarboxylic acids are most preferred.

Specific examples of preferred chelating agent are an ethylenediaminetetraacetic acid and a salt thereof and an ethylenediamine-N-(β-oxyethyl)-N,N',N'-triacetic acid and a salt thereof.

The organic acid metal complex salt used in this invention may be added to a bleach solution as the form of a complex salt or may be formed in a bleach solution by adding thereto a metal salt (such as, for example, ferric sulfate, ferric chloride, ammonium cobalt sulfate, copper sulfate, etc.) and the above-described chelating agent.

Preferred examples of metal ions are ferric ions, and in this case the amount of the ferric ion complex salt is preferably from about 0.0001 to 2 mols, and more preferably from 0.01 to 0.2 mol, per mol of bleach solution.

Preferred examples of compounds capable of releasing hydrogen peroxide that can be used in this invention are perboric acid (or the salts thereof) and percarbonic acid (or the salts thereof).

The amount of hydrogen peroxide or a compound releasing hydrogen peroxide is preferably from 0.005 to 10 mols, and more preferably from 0.02 to 2 mols, per liter of bleach solution.

In this invention it is preferred, for increasing the stability of the bleach solution, to add substituted or unsubstituted aromatic sulfonic acids (or the salts thereof) or the substituted or unsubstituted aromatic polyvalent sulfonic acids (or the salts thereof), as shown by formula (III):

$$Q\text{-}(SO_3M)_n \quad \text{(III)}$$

wherein Q represents a substituted or unsubstituted aromatic hydrocarbon group or an aromatic heterocyclic group containing at least one nitrogen atom or sulfur atom; M represents hydrogen, an alkali metal atom, or an ammonium group; and n is an integer of from 1 to 5.

The substituent of the substituted aromatic hydrocarbon group shown by Q may be a carboxy group, a hydroxy group, an amino group, a nitro group, a nitroso group, an aliphatic group (which may be substituted by a halogen atom), or an aromatic hydrocarbon group, and further preferred examples of the above-described substituent are a carboxy group, a hydroxy group, an amino group, a nitro group, a nitroso group or a halogen atom.

When a compound shown by formula (III) is added to the replenisher used in this invention, the compound may be incorporated in the first composition containing hydrogen peroxide or a compound releasing hydrogen peroxide, or may be incorporated in the second composition containing the organic acid metal complex salt.

Practical examples of the compound shown by formula (III) are as follows:

(1)
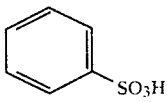
(2)
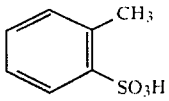
(3)
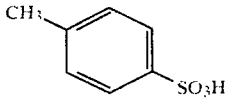
(4)
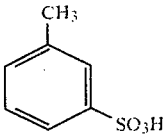
(5)
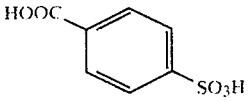
(6)
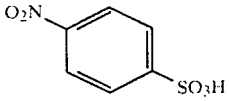
(y)
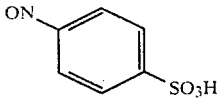
(8)
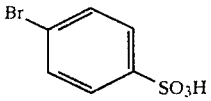
(9)
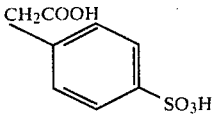
(10)
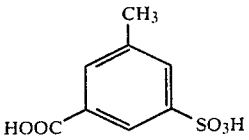
(11)
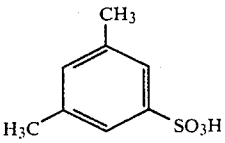
(12)
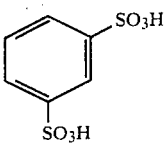
-continued
(13)
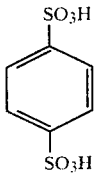
(14)
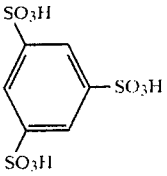
(15)
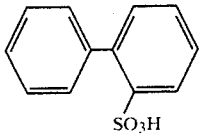
(16)
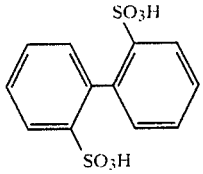
(17)
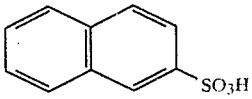
(18)
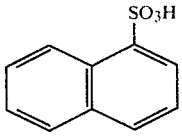
(19)
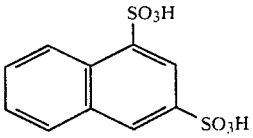
(20)
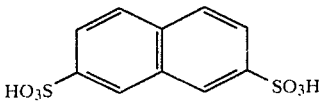
(21)
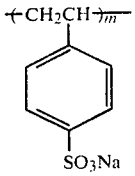
m = 1 to 10
(22)
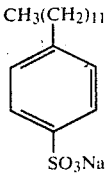

-continued (23)

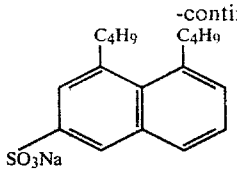

(24)

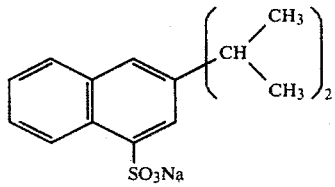

(25)

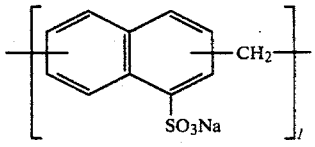

l = 1 to 8

(26)

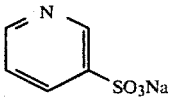

(27)

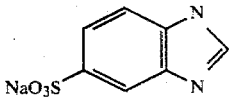

(28)

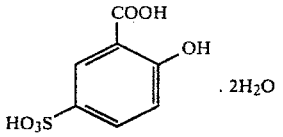

(29)

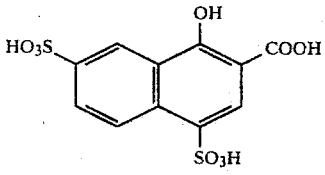

(3)

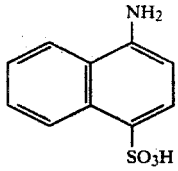

A useful amount of the compound shown by formula (III) can be from about $5\times10^{-5}$ to 0.3 mol, and a preferable amount is from $10^{-3}$ to 0.1 mol, per liter of bleach solution. When the compound of formula (III) is a polymer, the term "amount" refers to the molar number of sulfone groups.

In this invention it is preferred, from the viewpoint of the efficiency, that the number of mols of hydrogen peroxide per liter of bleach solution be larger than the number of mols of ferric ions, and it is more preferable that the former be twice as large as the latter.

The bleach solution used in this invention may contain various other additives together with the above-described compounds. Examples of the additives preferably added for accelerating bleaching are halides such as alkali halides and ammonium halides, for example, potassium bromide, sodium bromide, ammonium bromide, sodium chloride, etc. The amount of the additive can be from about 0.01 to 5 mols, and preferably is from 0.2 to 2 mols, per liter of bleach solution. Furthermore, it is preferred to add an aliphatic carboxylic acid, an aliphatic phosphonic acid, or an aliphatic phosphonocarboxylic acid, such as, for example, acetic acid, an acetate, propionic acid, a propionate, succinic acid, a succinate, malonic acid, a malonate, a citric acid, a citrate, 2,2-diphosphonoethanol or a salt thereof, or 2-phosphono-1,2,4-tricarboxylic acid or a salt thereof. The amount thereof can be from about 0.01 to 5 mols, and preferaby is from 0.1 to 2 mols, per liter of bleach solution.

Also, a pH buffer such as a borate, an acetate, a phosphate, etc.; a pH adjusting agent such as sodium hydroxide, aqueous ammonia, etc.; a corrosion preventing agent such as ammonium nitrate, etc.; and a swelling inhibitor such as ammonium sulfate, a surface active agent (e.g., polyethylene oxide, etc.) may be added in conventional amounts to the bleach solution.

When silver halide color photographic materials are processed using the method of this invention, a substituted alkylthiol compound or a precursor therefor may be added to a bath used in a step prior to the bleaching step as a bleach accelerator. Such substituted alkylthiol compounds or the precursors therefor are described, for example, in *Research Disclosure,* item no. 15704 (May, 1977); and Japanese Patent Application (OPI) Nos. 20832/77, 32736/78, 94927/78, 95630/78 and 95631/78.

The substituted alkylthiol compounds or the precursors therefor used in this invention may be shown by the following formula (IV)

$$R\text{-}S\text{-}Y \qquad \text{(IV)}$$

wherein R represents a substituted alkyl group having from 1 to 10 carbon atoms as an alkyl moiety, which may be branched; at least one of the substituents of R being a hydroxy group, a primary, secondary, or tertiary amino group, a carboxy group, a sulfone group, a piperidino group, a pyrrolyl group, a morpholino group, an imidazole group, or a benztriazole group; and Y represents hydrogen or an amidino group.

Practical examples thereof are as follows:

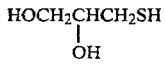

(IV-1)

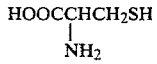

(IV-2)

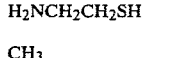

(IV-3)

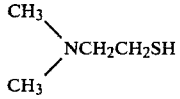

(IV-4)

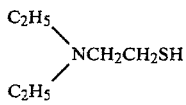

(IV-5)

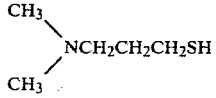

(IV-6)

-continued

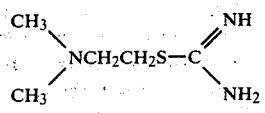
(IV-7)

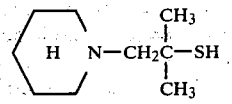
(IV-8)

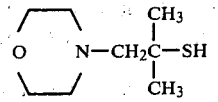
(IV-9)

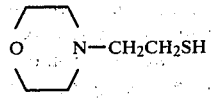
(IV-10)

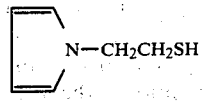
(IV-11)

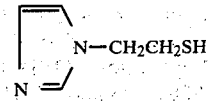
(IV-12)

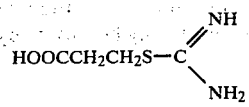
(IV-13)

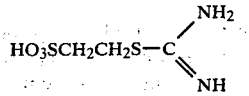
(IV-14)

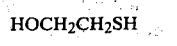
(IV-15)

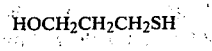
(IV-16)

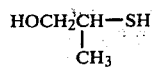
(IV-17)

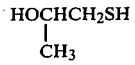
(IV-18)

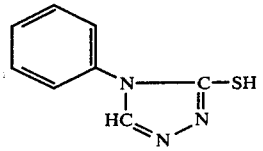
(IV-19)

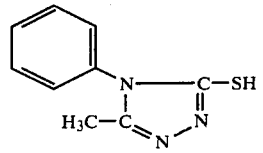
(IV-20)

These compounds may be used in the form of salt, for example, a hydrochloride. Also, the above-illustrated compounds are typical examples, and the substituted alkylthiol compounds or the precursors therefor used in this invention are not limited to these compounds.

The amounts of addition of these compounds in the bleach solution is preferably from $1\times10^{-15}$ mol/liter to 1 mol/liter, more preferably $1\times10^{-3}$ mol/liter to $1\times10^{-1}$ mol/liter.

The processing bath containing these compounds is a color developer or a processing bath used after a color developing step and before a bleaching step. For example, the processing bath can be a color developer, a stop bath, or a stop fix bath.

When a processing bath containing the substituted alkylthiol compound or the precursor thereof is used before bleaching silver halide color photographic materials using the bleach solution in accordance with the method of this invention, the period of time required for bleaching is greatly shortened.

The material of the tank for the bleach solution used in this invention is preferably plastic, such as a vinyl chloride resin, but may also be a metal, such as titanium alloy and stainless steel.

The above-described contents of the various compounds in the bleach solution used in this invention are the amounts of them that are used in the bleach solution directly for processing color photographic materials. On the other hand, the composition of a replenisher for replenishing chemicals in accordance with the changes in the composition of the bleach solution, i.e., the consumption caused by the use of the bleach solution for processing color photographic materials and caused with the passage of time after the preparation of the bleach solution as well as the concentration of the bleach solution caused by evaporation is determined according to the kind of photographic materials to be processed and the preservative conditions and the conditions of using the bleach solution, but the composition of the replenisher is preferably from about 0.5 to 3 times, and more preferably from 0.8 to 2 times, the concentration thereof in the bleach solution. However, when the bleach solution is used after allowing it to stand for a long period of time without being used, it is desirable to replenish the composition containing hydrogen peroxide or a compound releasing hydrogen peroxide at the time of initiating processing.

The pH of the bleach solution used in this invention is typically from 1 to 10, and preferably from 3 to 8.

The replenisher used in this invention may be composed of compositions wherein hydrogen peroxide or a compound releasing hydrogen peroxide does not substantially exist together with an organic acid metal complex salt. Other additives in addition to the above components may be incorporated in either the first or second compositions that constitute the replenisher, and the replenisher may be composed of more than two compositions. For example, additional compositions containing additives such as a pH adjuster, a swelling inhibitor, etc., can be added. However, for controlling the decomposition of hydrogen peroxide during the preservation of the replenisher as low as possible, it is preferred that the composition containing hydrogen peroxide does not contain additives other than a stabilizer for hydrogen peroxide although the invention does not exclude other embodiments than the above. For example, it is preferred for inhibiting the decomposition of hydrogen peroxide to keep the composition containing hydrogen peroxide at an acidic state, by adding thereto a mineral acid such as, for example, hydrochloric acid, sulfuric acid, nitric acid, phosphoric acid, etc.;

an organic carboxylic acid such as, for example, formic acid, acetic acid, propionic acid, maleic acid, etc.; an aminopolycarboxylic acid such as those shown by the formula (II) described above; or an organic phosphonic acid such as, for example, 1,3-diaminopropanol-N,N,N',N'-tetramethylenephosphonic acid, etc.

In a bleaching method of this invention, overflow solution from the processing bath caused by the addition of the replenisher can be recovered and repeatedly used as a composition for the replenisher. In this case the overflow solution contains hydrogen peroxide and an organic acid metal complex salt together, but since the content of hydrogen peroxide in the overflow solution has been greatly reduced by the passage of time, the solution may be used as a composition containing the organic acid metal complex salt, with the existence of hydrogen peroxide being ignored. The overflow solution may be wholly or partially used as the replenisher, or it may be used after supplying thereto deficient components or water as part of the replenisher. In other words, in this invention, a composition containing hydrogen peroxide and an organic acid metal complex salt together may be used as the replenisher, if a composition containing hydrogen peroxide but substantially no organic acid metal complex salt is used separately from the above composition.

There are various manners for replenishing the bleach solution in this invention. For example, in one method at least two tanks are connected to a bleaching bath by means of conduits. A first composition containing hydrogen peroxide (or a compound releasing hydrogen peroxide) is placed in a first of these tanks, while second composition containing an organic acid metal complex salt is placed in the second tank, and both compositions are added to the bleaching bath separately.

In a second method, a first tank containing hydrogen peroxide (or a compound releasing hydrogen peroxide) is connected to a second tank containing an organic acid metal complex salt at a position connected to the bleaching bath and both compositions are added to the bleaching bath after being mixed.

In a third method, a first tank containing hydrogen peroxide (or a compound releasing hydrogen peroxide), a second tank containing an organic acid metal complex salt, and a bleaching bath are connected in series by means of a conduit, and after first adding the composition containing hydrogen peroxide to the composition containing the organic acid metal complex salt, the resultant composition is added to the bleaching bath.

In each method, it is desirable that the composition containing hydrogen peroxide (or a compound releasing hydrogen peroxide) and the composition containing an organic acid metal complex salt are separated from each other at least until substantially immediately before replenishing the bleach solution. Thus during replenishing according to this invention, both compositions may be added as a mixture thereof or may be added separately to the bleaching solution bath.

When the compositions to be supplied are liquids, they may be added to the bleaching bath by means of metering pumps, or may be added by controlling the amounts thereof using cocks or valves, or further tanks having graduations are used and the compositions are added intermittently in predetermined amounts with the aid of the graduations. When either of the first or second compositions constituting the replenisher is a powder, the composition may be added by a general method, as described in *Funtai, Riron to Ohyo* (*Powder, Theory and Application*), edited by Kiichiro Kubo, Eiji Mizuwatari, Yuzo Nakagawa, and Sohachiro Hayakawa (published by Maruzen K.K. In 1962). Many other methods of adding the replenishers than above can be employed in this invention without special restrictions on the manner of addition.

The method of this invention can applied for the processing of all color photographic materials using silver halide emulsions such as color papers, color negative films, color reversal films, color positive films, etc., but is more effectively applied to the processing of color photographic materials using high silver content silver halide emulsions having more than 20 mg/100 $cm^2$ of the total silver amounts in the silver halide emulsion layers, in particular, color photographic materials using silver halide emulsions having more than 30 mg/100 $cm^2$ of the total silver amounts.

The method of this invention can be included in various combinations of processing steps for image-exposed color negative films, color positive films, color papers, etc. such as:

(1) color development→bleach→wash→fix→wash→stabilization→dry;
(2) color development→stop→bleach→wash→fix→wash→stabilization→dry;
(3) color development→stop→bleach→fix→wash→stabilization→dry; or
(4) color development→step fix→bleach→fix→wash→stabilization→dry. In (1) through (4), a pre-bath and a hardening bath may be further employed before color development, and also a wash, etc., after stabilization or bleach may be omitted.

The combinations of processing steps typically employed for color reversal films, to which the method of this invention can also be applied, are:

(5) black and white development→stop→wash→fogging→wash→color development→stop→wash→bleach→wash→fix→wash→stabilization→dry; or
(6) black and white development→stop→wash→fogging→wash→color development→stop→wash→bleach→fix→wash→stabilization→dry.

In (5) and (6), a pre-bath, a pre-hardening bath, a neutralizing bath, etc., may also be employed. Also, a wash, etc., after the stabilization, bleach, may be omitted. In the photographic method of this invention, the combinations of processing steps (1) to (6) described above are useful, but the invention is not limited to such combinations.

A color photographic material processed by the method of this invention includes at least one silver halide emulsion layer on a support, and, in a preferred embodiment, the color photographic material has a red-sensitive silver halide emulsion layer, a green-sensitive silver halide emulsion layer, and a blue-sensitive silver halide emulsion layer on a support. Each of these silver halide emulsion layers contains a dye-forming coupler or a dye which is bleached using silver as catalyst. Such a photographic element may further include non-photosensitive photographic layers (e.g., an antihalation layer, an interlayer for preventing color mixing, etc., a yellow filter layer, a protective layer, etc.). Also, there are no particular restrictions with respect to the order of disposition of the above-described red-sensitive emulsion layer, green-sensitive emulsion layer, and blue-sensitive emulsion layer. The silver halide emulsions used in this invention may be of a surface latent image type or an internal latent image type and may be prepared according to conventional methods.

As described above in detail, there are no particular restrictions on the production of silver halide emulsions for color photographic materials used in this invention, the layer structures of the color photographic materials, additives, materials for photographic materials, and photographic processing compositions.

The invention will further be described in more detail by the following examples.

EXAMPLE 1

A color reversal photographic material was prepared by successively coating the following layers on a triacetate film:

Layer 1 (red-sensitive silver halide emulsion layer)

The coating composition was prepared by mixing a red-sensitive silver iodobromide emulsion (7 mol% silver iodide) and a cyan coupler emulsion (1-hydroxy-4-chloro-2-n-dodecylnaphthamide as a cyan coupler and dibutyl phthalate as a coupler solvent) in such a manner that the silver/coupler mol ratio became 8.0 and coated at a silver coverage of 1.5 g-Ag/m$^2$.

Layer 2 (interlayer)

A gelatin interlayer having dispersed therein di-t-amylhydroquinone.

Layer 3 (green-sensitive silver halide emulsion layer)

The coating composition was prepared by mixing a green-sensitive silver iodobromide emulsion (6 mol% silver iodide) and a magenta coupler emulsion (1-(2,4,6-trichlorophenyl)-3-[3-(2,4-di-t-amylphenoxyacetamido)benzamido]-5-pyrazolone as magenta coupler and tricresyl phosphate as coupler solvent) in such a manner that the silver/coupler mol ratio became 9.5 and coated at a silver coverage of 1.5 g-Ag/m$^2$.

Layer 4 (Yellow filter layer)

A filter layer composed of yellow colloid silver and gelatin.

Layer 5 (blue-sensitive silver halide emulsion layer)

The coating composition was prepared by mixing a blue-sensitive silver iodobromide emulsion (6 mol% silver iodide) and a yellow coupler emulsion ($\alpha$-pivaloyl-2-chloro-5-[$\gamma$-(2,4-di-t-amylphenoxy)-butanamido]acetanilide as yellow coupler and dibutyl phthalate as coupler solvent) in such a manner that the silver/coupler mol ratio became 8.0 and coated at a silver coverage of 1.8 g-Ag/m$^2$.

Layer 6 (protective layer)

A protective layer mainly composed of gelatin.

The color reversal film was exposed through an optical wedge to a tungsten lamp for 1/100 second and then subjected to the following reversal processing:

| Processing Step | Temperature (°C.) | Time |
|---|---|---|
| First development (black-and-white) | 43 | 2 min. |
| Stop | 40 | 20 sec. |
| Wash | 40 | 40 sec. |
| Color development | 46 | 2 min |
| Stop | 40 | 20 sec. |
| Wash | 40 | 1 min. |

-continued

| Processing Step | Temperature (°C.) | Time |
|---|---|---|
| Bleach | 40 | 90 sec. |
| Fix | 40 | 40 sec. |
| Wash | 40 | 1 min. |
| Stabilization | 40 | 20 sec. |
| Dry | 37 | |

The compositions of the processing solutions used in the above processing steps were as follows:

| | |
|---|---|
| Composition of the first developer | |
| Sodium sulfite | 60.0 g |
| 1-Phenyl-3-pyrazolidone | 0.3 g |
| Hydroquinone | 5.0 g |
| Sodium carbonate(monohydrate) | 41.0 g |
| Potassium bromide | 2.0 g |
| Potassium iodide(1% aq. soln.) | 1.0 ml |
| Potassium rhodanine(1N aq. soln.) | 10.0 ml |
| Sodium hydroxide (10% aq. soln.) | 2.0 ml |
| Water to make | 1.0 l |
| Composition of the stop solution | |
| Sodium acetate | 30 g |
| Glacial acetic acid | 8 ml |
| Water to make | 1 l |
| Composition of the color developer | |
| Benzyl alcohol | 5.0 ml |
| Sodium hydroxide | 0.5 g |
| Diethylene glycol | 3.0 ml |
| Sodium hexamethylenemetaphosphate | 2.0 g |
| Sodium sulfite | 2.0 g |
| Potassium bromide | 2.0 g |
| Ethyl-N-($\beta$-methanesulfonamidoethyl)-aniline sesquisulfate monohydrate | 9.0 g |
| Citrazinic acid | 0.4 g |
| Metaboric acid | 0.5 g |
| Sodium metaborate tetrahydrate | 77.0 g |
| Sodium borohydrate | 0.1 g |
| Water to make | 1 l |
| Composition of the fix solution | |
| Sodium thiosulfate | 200 g |
| Sodium sulfite | 15 g |
| Borax | 12 g |
| Glacial acetic acid | 15 ml |
| Water to make | 1 l |
| Composition of the stabilizing solution | |
| Formalin (37%) | 10 ml |
| Fuji Driwel (trademark) (aqueous surfactant solution) | 5 ml |
| Water to make | 1 l |

In the above processing steps, bleaching periods of time, and the composition of the bleach solution were as follows:

| | |
|---|---|
| Bleaching time: | 1 min., 1 min. 30 sec., 2 min., 2 min. 30 sec., 3 min., 3 min. 30 sec., 5 min., 10 min., and 20 min. |

The foregoing bleaching times mean that (1) after 1 min. of bleaching, Sample 1 was taken out to inspect the degree of bleaching; if not completely bleached, (2) Sample 2 was taken out 1 min. 30 sec. after; if still insufficiently bleached, (3) Sample 3 was checked after 2 min., etc. If bleaching is completed, e.g., with Sample 3, it is concluded that time required for complete bleaching was 2 min. (I.e., complete bleaching occurs between 1 min. 30 sec. and 2 min.) Thus, the various bleaching times listed were used to determine one result for each test, i.e., time required for complete bleaching, as shown in Table 1 below.

Completion of bleaching was determined by measuring the residual amount of Ag and leuco dye density in the film using fluorescent X-ray spectroscopy. Thus, in Example 1 (see Table 1) below, bleaching was considered complete when the residual Ag in a film became 3 $\mu g/cm^2$ or less.

| Composition of the bleach solution | |
|---|---|
| Ethylenediaminetetraacetic acid disodium salt | 0.5 g |
| Ethylenediaminetetraacetic acid ferric ammonium dihydrate | 10 g |
| Compound (28) illustrated above | 2 g |
| Ammonium bromide | 140 g |
| Acetic acid | 20 ml |
| 30% Hydrogen peroxide | 20 ml |
| Aqueous ammonia and water to make | 1 l |
| | pH 4.0 |

Replenisher 1

Following compositions (A) and (B) were prepared and they were stored separately.

Composition (A)

An aqueous solution of 30% hydrogen peroxide.

| Composition (B): | |
|---|---|
| Ethylenediaminetetraacetic acid disodium dihydrate | 0.7 g |
| Ethylenediaminetetraacetic acid ferric ammonium dihydrate | 13.2 g |
| Compound (28) dihydrate | 2.6 g |
| Ammonium bromide | 330 g |
| Glacial acetic acid | 26.3 ml |
| Aqueous ammonia and water to make | 1 l |
| | pH 3.8 |

Replenisher 2 (comparison)

A solution composed of a mixture of Composition (A) and Composition (B) as in Replenisher 1 in a ratio of 1:24.

Processing steps other than bleaching were performed in conventional manners, and the bleaching step was performed according to the method of following bleaching test 1 or bleaching test 2 (comparison test).

Bleaching test 1

The bleaching process was performed while supplying the compositions of Replenisher 1 as follows:

In a bleaching bath was placed 100 liters of the bleach solution described above and with every processing of 1 square meter of the reversal film prepared above, 12 ml of Composition (A) and 288 ml of Composition (B) were supplied. The solution that overflowed from the bleaching bath caused by the addition of the replenishers was collected and stored in a storage tank. When the amount of the overflowed solution was over 10 liters, 1.5 liters of the overflowed solution was discarded and 1.5 liters of Composition (B) for the Replenisher 1 was added to remaining 8.5 liters of the overflowed solution. The resultant solution was used in place of Composition (B) for the Replenisher 1. In this case, a fresh aqueous solution of 30% hydrogen peroxide was used as Composition (A) and the Replenisher was supplied in such manners that the ratio of the amount of Composition (A) to the amount of Composition (B) became about 1:24 and the addition amount of these compositions became 300 ml per square meter of the reversal film processed. Thus, reversal film was processed at a rate of about 130 square meters per day over a period of 2 weeks, the net processed period being 11 days.

Thereafter, the same bleaching test was performed using the reversal film described above and the time required for finishing the bleaching was determined as well as the concentration of hydrogen peroxide in the bleach solution was analyzed.

Bleaching test 2 (comparison test)

The bleaching procedure was performed while supplying the composition for Replenisher 2 by the following manner.

In a bleaching bath was placed 100 liters of the fresh bleaching solution having the same composition as in bleaching test 1 and with every processing of 1 square meter of the reversal film, 300 ml of the composition (containing hydrogen peroxide and the organic acid ferric complex salt together) for Replenisher 2 was supplied. The solution overflowed from the bleaching bath with the addition of the replenisher was collected and stored in a storage tank. After discarding 1.5 liters of the overflowed solution from 10 liters thereof thus stored, 1.5 liters of the composition for Replenisher 2 was added to remaining 8.5 liters of the overflowed solution. The resultant solution was used as the composition for Replenisher 2. This procedure was repeatedly performed during the continuation of processing.

The bleach processing was performed in the same manner as in bleaching test 1, except for the manner of supplying the replenisher, and, after 2 weeks the time required for finishing the bleaching and the concentration of hydrogen peroxide in the bleach solution were determined.

The results in bleaching test 1 and bleaching test 2 are shown in Table 1.

TABLE 1

| Bleaching Test | Time Required for Finishing Bleaching | Remaining Amount of 30% Hydrogen Peroxide |
|---|---|---|
| Test 1 (this invention) | 2 min 30 sec | 22 ml/l |
| Test 2 (comparison) | 20 min | 0.3 ml/l |
| Fresh bleach solution immediately after preparation thereof | 2 min 20 sec | 18 ml/l |

From the above results, it is understood that in the case of bleach test 1 the content of the bleach solution after 2 weeks was higher than that of the bleach solution immediately after the preparation thereof, the time required for finishing bleaching was the same as that in the case of using the bleach solution immediately after the preparation thereof, and thus the function of the bleach solution was maintained at almost a constant level, while in bleaching test 2 the content of hydrogen peroxide in the bleach solution was reduced greatly, the time required for finishing bleaching was prolonged, and hence the function of the bleach solution was deteriorated.

Also, in the system of bleaching test 1 (this invention), the photographic properties (fog density, coloring density, etc.) of the reversal color film thus processed were almost the same as those in the case of processing using the bleach solution immediately after the preparation thereof, thus showing that the method of this invention is advantageous as compared with a conventional replenishing system.

Bleaching test 3

Bleaching solutions were prepared, which had the same composition as described above but contained 1.6, 2.3, 4.0, 8.0, 20.0 and 40.0 ml of a 30% aqueous hydrogen peroxide solution, respectively.

Reversal films prepared as described above were exposed in a manner similar to the above. Thereafter, the same processing was performed except that a bleaching time was 2 min. and 30 sec.

Results obtained are shown in Table 2 below.

TABLE 2

| Addition of 30% $H_2O_2$ (ml) | Total Amount of Residual Ag $D_{min}$ ($\mu g/cm^2$) | $D_{max}$ ($\mu g/cm^2$) | $D_{min}$ Yellow | Magenta | Cyan | $D_{max}$ Yellow | Magenta | Cyan |
|---|---|---|---|---|---|---|---|---|
| 1.6 | 24.0 | 28.3 | 0.23 | 0.23 | 0.23 | 3.08 | 2.82 | 3.02 |
| 2.3 | 5.2 | 8.6 | 0.14 | 0.14 | 0.14 | 3.02 | 2.76 | 2.96 |
| 4.0 | 2.5 | 4.5 | 0.12 | 0.12 | 0.12 | 2.98 | 2.72 | 2.92 |
| 8.0 | 2.5 | 4.5 | 0.12 | 0.12 | 0.12 | 2.98 | 2.72 | 2.92 |
| 20.0 | 2.3 | 4.2 | 0.12 | 0.13 | 0.12 | 2.98 | 2.74 | 2.92 |
| 40.0 | 2.1 | 4.0 | 0.12 | 0.13 | 0.12 | 2.98 | 2.74 | 2.92 |

$D_{min}$ and $D_{max}$ with the system containing 1.6 and 2.3 ml of a 30% aqueous hydrogen peroxide solution are large due to a large amount of the residual silver.

From the results above, it is clear that the total amount of the residual silver, $D_{min}$ and $D_{max}$ are not changed when the hydrogen peroxide content is maintained at a certain level.

While the invention has been described in detail and with reference to specific embodiments thereof, it will be apparent to one skilled in the art that various changes and modifications can be made therein without departing from the spirit and scope thereof.

What is claimed is:

1. A method for processing silver halide color photographic materials comprising bleaching silver halide color photographic materials with a bleach solution containing an organic acid metal complex salt and hydrogen peroxide or a compound releasing hydrogen peroxide wherein said hydrogen peroxide or said compound releasing hydrogen peroxide is present in an amount providing at least 0.02 mol hydrogen peroxide per liter of bleach solution, while adding thereto a replenisher composed separately of a first composition containing hydrogen peroxide or a compound releasing hydrogen peroxide and a second composition containing an organic acid metal complex salt.

2. A method for replenishing a silver halide color photographic material bleaching solution comprising an organic acid metal complex salt and hydrogen peroxide or a compound releasing hydrogen peroxide wherein said hydrogen peroxide or said compound releasing hydrogen peroxide is present in an amount providing at least 0.02 mol hydrogen peroxide per liter of bleach solution, comprising adding to said bleaching solution separately a first composition containing hydrogen peroxide or a compound releasing hydrogen peroxide, and a second composition containing an organic acid metal complex salt.

3. A method as in claim 1 or 2 wherein the first composition contains hydrogen peroxide, or a compound releasing hydrogen peroxide, and a stabilizer for hydrogen peroxide, and the concentration of hydrogen peroxide or a compound releasing hydrogen peroxide therein is from about 5% to 50% by weight, and the second composition contains an iron aminopolycarboxylic acid complex salt and other bleaching components.

4. A method as in claim 1 or 2 wherein the first composition containing hydrogen peroxide or a compound releasing hydrogen peroxide is continuously added during processing, while the composition containing an organic acid metal complex salt is added intermittently.

5. A method as in claim 1 or 2 wherein the bleaching is performed continuously or intermittently without adding the replenisher, and when the activity of the bleach solution is degraded, the replenisher composed of the separate compositions is added to the bleach solution to reactivate the bleach solution.

6. A method as in claim 1 or 2 wherein first and second compositions forming the replenisher are stored in separate first and second tanks, respectively, before use.

7. A method as in claim 6 wherein the concentration of hydrogen peroxide or a compound releasing hydrogen peroxide in the first composition stored in the first tank is from about 10% to 50% by weight.

8. A method as in claim 1, 2, 3, 4, 5, 6 or 7 wherein the concentration of hydrogen peroxide or a compound releasing hydrogen peroxide in the replenisher is from about 0.5 to 3 times the initial concentration thereof in the bleach solution.

9. A method as in claim 1, 2, 3, 4, 5, 6 or 7 wherein the concentration of hydrogen peroxide or a compound releasing hydrogen peroxide in the replenisher is from 0.8 to 2 times the initial concentration thereof in the bleach solution.

10. A method as in claim 1, 2, 3, 4, 5, 6 or 7 wherein the concentration of organic acid metal complex salt in the replenisher is from about 0.5 to 3 times the initial concentration thereof in the bleach solution.

11. A method as in claim 1, 2, 3, 4, 5, 6 or 7 wherein the concentration of organic acid metal complex salt in the replenisher is from about 0.8 to 2 times the initial concentration thereof in the bleach solution.

12. A method for processing silver halide color photographic materials comprising bleaching silver halide photographic materials with a bleach solution containing an organic acid metal complex salt and hydrogen peroxide or a compound releasing hydrogen peroxide, wherein said hydrogen peroxide or said compound releasing hydrogen peroxide is present in an amount providing at least 0.02 mol hydrogen peroxide per liter of bleach solution, while adding thereto a replenisher composed separately of a first composition containing hydrogen peroxide or a compound releasing hydrogen peroxides and a stabilizer for hydrogen peroxide, with the concentration of hydrogen peroxide or compound releasing hydrogen peroxide therein being about 5% to 50% by weight and wherein the concentration of hydrogen peroxide or compound releasing hydrogen peroxide is from about 0.5 to 3 times the initial concentration of hydrogen peroxide in the bleach solution and a second composition containing an iron aminopolycarboxylic acid complex salt and other bleaching components.

* * * * *